US008556135B2

(12) United States Patent
Edmondson

(10) Patent No.: US 8,556,135 B2
(45) Date of Patent: Oct. 15, 2013

(54) 360° DIP TUBE PICK-UP ADAPTER

(75) Inventor: Lorna K. Edmondson, Loudonville, OH (US)

(73) Assignee: Dometic Corporation, Elkhart, IN (US)

( * ) Notice: Subject to any disclaimer, the term of this patent is extended or adjusted under 35 U.S.C. 154(b) by 733 days.

(21) Appl. No.: 12/613,125

(22) Filed: Nov. 5, 2009

(65) Prior Publication Data

US 2011/0101038 A1 May 5, 2011

(51) Int. Cl.
*B67D 7/78* (2010.01)

(52) U.S. Cl.
USPC ..... 222/464.1; 222/377; 222/382

(58) Field of Classification Search
USPC ..... 222/464.1, 382, 377, 189.1
See application file for complete search history.

(56) References Cited

U.S. PATENT DOCUMENTS 1,489,172 A * 4/1924 Symons ..... 222/108
2,612,998 A * 10/1952 Smith ..... 137/559
2,950,030 A * 8/1960 McConnohie ..... 222/189.1
3,023,937 A * 3/1962 Matter ..... 222/440
3,549,015 A * 12/1970 Willinger ..... 210/416.2
3,734,853 A * 5/1973 Horvath ..... 210/167.25
4,797,206 A * 1/1989 Lynch ..... 210/167.16
5,069,243 A 12/1991 Foreman
5,186,354 A 2/1993 Coffey et al.
5,323,938 A * 6/1994 Ceccarelli et al. ..... 222/442
5,408,704 A 4/1995 Bailey et al.
5,621,924 A 4/1997 Friedman et al.
5,681,148 A 10/1997 Friedman et al.
5,931,642 A 8/1999 Friedman et al.
5,947,146 A 9/1999 Bailey et al.
6,038,710 A 3/2000 Baron
6,142,257 A * 11/2000 Bruener et al. ..... 184/12
6,148,860 A 11/2000 Sigler
6,234,197 B1 5/2001 McKiernan et al.
6,374,431 B1 4/2002 Dahlberg
6,397,407 B1 6/2002 Dahlberg
6,644,511 B2 * 11/2003 Hsu et al. ..... 222/129
6,701,975 B1 * 3/2004 Neal ..... 141/18
2010/0252136 A1 * 10/2010 Koch ..... 138/109
2011/0011895 A1 * 1/2011 Michitsuji et al. ..... 222/382

* cited by examiner

*Primary Examiner* — Paul R. Durand
*Assistant Examiner* — Donnell Long
(74) *Attorney, Agent, or Firm* — Pearne & Gordon LLP

(57) ABSTRACT

An end piece is adapted for connection and fluid communication with a dip tube for drawing in matter through suction. The end piece includes an upper part and a lower part. The upper part is connected with the bottom end of the tube. The lower part includes an upper base, a lower base and an enclosing wall by which the lower base is joined to the upper base. The enclosing wall defines a hollow space between the upper base and the lower base. The lower base is larger in area than the upper base such that the hollow space is tapered toward the upper base. The lower base provides an opening for matter to enter.

8 Claims, 4 Drawing Sheets

360° DIP TUBE PICK-UP ADAPTER

FIELD OF THE INVENTION

The present invention relates generally to dip tubes, and more particularly, to dip tubes inserted into empty containers.

BACKGROUND OF THE INVENTION

Dip tubes for emptying the contents of tanks are generally constructed by modifying commonly used plumbing pipes and fittings, and gluing these pieces together to produce a structure with an opening that is near the floor of the tank. The dip tube is often provided with an opening that is substantially oval because such geometry of the opening reduces the likelihood of clogging. Moreover, it is helpful to allow the dip tube to rotate about the tank so that the dip tube can facilitate connection with neighboring pipes or tubes that approach the dip tube assembly. However, the rotation of the dip tube is restricted because the tank walls or hull often gets in the way of the rotation inside the tank. Thus, there is a need to provide a dip tube that overcomes the above limitation while providing the same benefits.

BRIEF SUMMARY OF THE INVENTION

Accordingly, it is an aspect of the present invention to obviate problems and shortcomings of conventional dip tubes.

To achieve the foregoing and other aspects and in accordance with the present invention, an end piece adapted for connection and fluid communication with a dip tube for drawing in matter through suction is provided. The end piece includes an upper part and a lower part. The upper part is configured to be connected to a dip tube. The lower part includes an upper base, a lower base and an enclosing wall by which the lower base is joined to the upper base. The enclosing wall defines a hollow space between the upper base and the lower base. The lower base is larger in area than the upper base such that the hollow space is tapered toward the upper base. The lower base provides an opening for matter to enter.

To achieve further aspects and in accordance with the present invention, a dip tube assembly for drawing in matter through suction from a container and configured to establish fluid communication with a container is provided. The dip tube assembly includes a fitting, a tube, and an end piece. The fitting is configured to secure the assembly to a container. The tube includes a top end and a bottom end. The top end of the tube is configured to be connected to the fitting. The end piece includes an upper part and a lower part. The upper part is configured to be connected with a dip tube. The lower part includes an upper base, a lower base and an enclosing wall by which the lower base is joined to the upper base. The enclosing wall defines a hollow space between the upper base and the lower base. The lower base is larger in area than the upper base such that the hollow space is tapered toward the upper base. The lower base provides an opening for matter to enter.

To achieve still further aspects and in accordance with the present invention, a container includes a hull defining an interior space for storage and a dip tube assembly for drawing in matter through suction from the container. The dip tube assembly is in fluid communication with the container and includes a fitting, a tube and an end piece. The fitting is configured to secure the assembly to the container. The tube includes a top end and a bottom end. The top end of the tube is connected to the fitting. The end piece includes an upper part and a lower part. The upper part is connected with the bottom end of the tube. The lower part includes an upper base, a lower base and an enclosing wall by which the lower base is joined to the upper base. The enclosing wall defines a hollow space between the upper base and the lower base. The lower base is larger in area than the upper base such that the hollow space is tapered toward the upper base. The lower base provides an opening for matter to enter.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
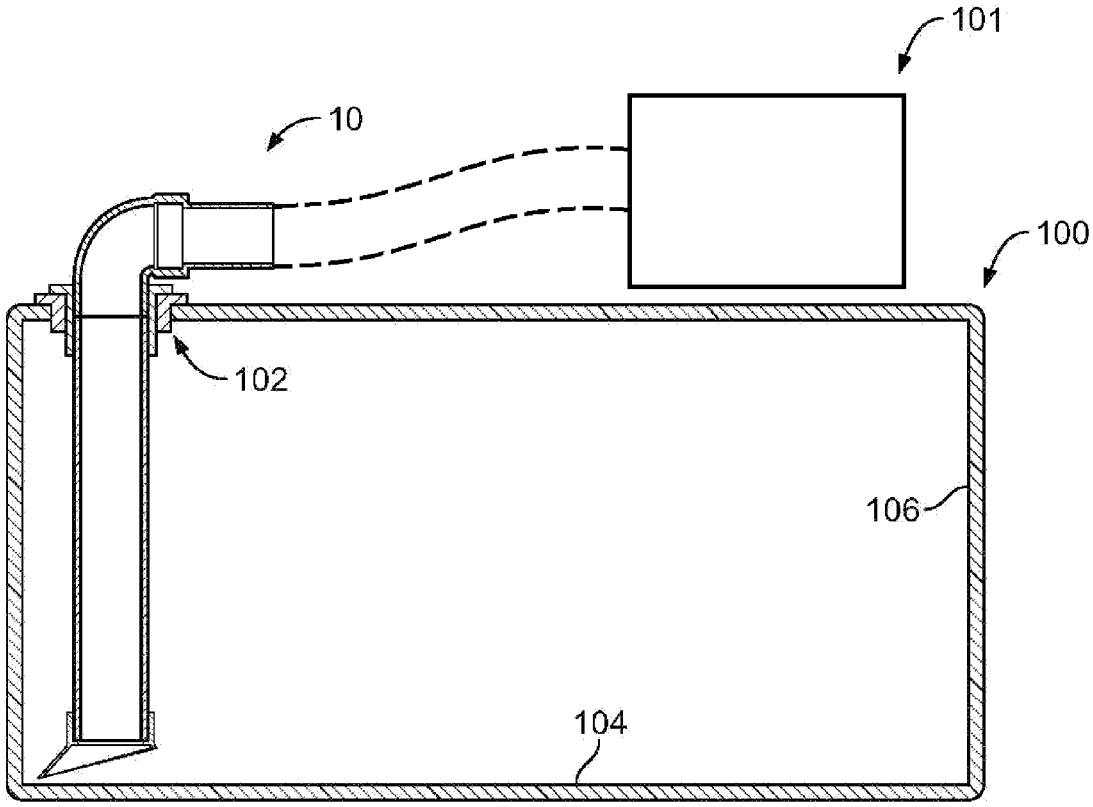
FIG. 1 is an example embodiment of a container implementing a dip tube assembly according to the present invention.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices.

FIG. 1 shows an example embodiment of a container 100 in which the present invention can be implemented. The container 100 may be any type of storage means, such as a tank, a reservoir, a vessel or the like, in which material in solid, liquid, or gas state or a mixture thereof can be stored. For example, the container 100 may be used to store waste such as urine, fecal matter, toilet paper or the like. The container 100 includes a dip tube assembly 10 for removing the contents of the container 100 from within through a suction effect that can be created by means 101 known in the art, such as a pump, a siphon, or the like. The dip tube assembly 10 may be inserted from above or a top area of the container 100. A mounting of the dip tube assembly 10 from above creates a hole 102 at the top and prevents the contents of the container from leaking or spilling in case of malfunction of the assembly as compared to mounting from below. Moreover, depending on where the assembly 10 is mounted, space may be available for other components of the tank, such as other fittings, pump assemblies, level indicator equipments, or the like, which are omitted for clarity of illustration in FIG. 1. The dip tube assembly 10 is located and sized to reach a floor 104 of the container 100 so that substantially all of the contents of the container 100 can be drawn in or picked up by the dip tube assembly 10 through suction.

Figure 2A:
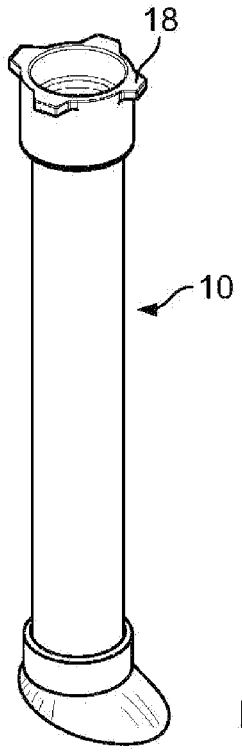
FIG. 2A is a perspective view of a first example embodiment of the dip tube assembly.
Figure 2B:
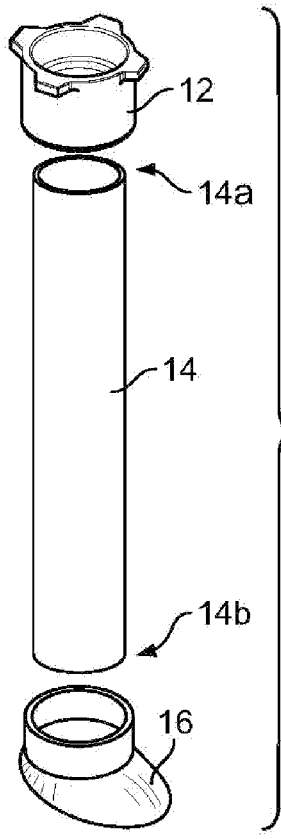
FIG. 2B is an exploded view of the first example embodiment of the dip tube assembly.
Figure 3A:
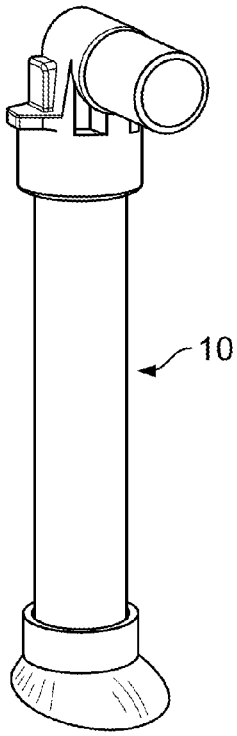
FIG. 3A is a perspective view of a second example embodiment of the dip tube assembly.
Figure 3B:
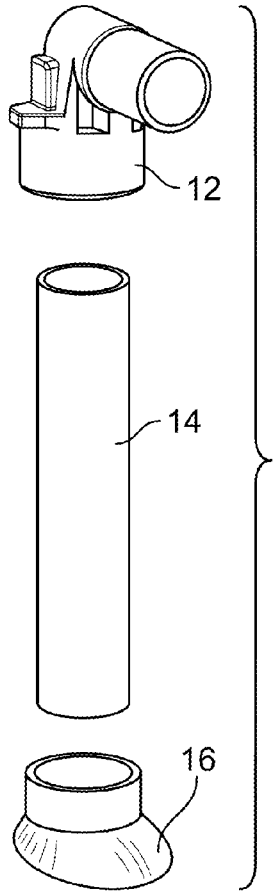
FIG. 3B is an exploded view of the second example embodiment of the dip tube assembly.
Figure 4:
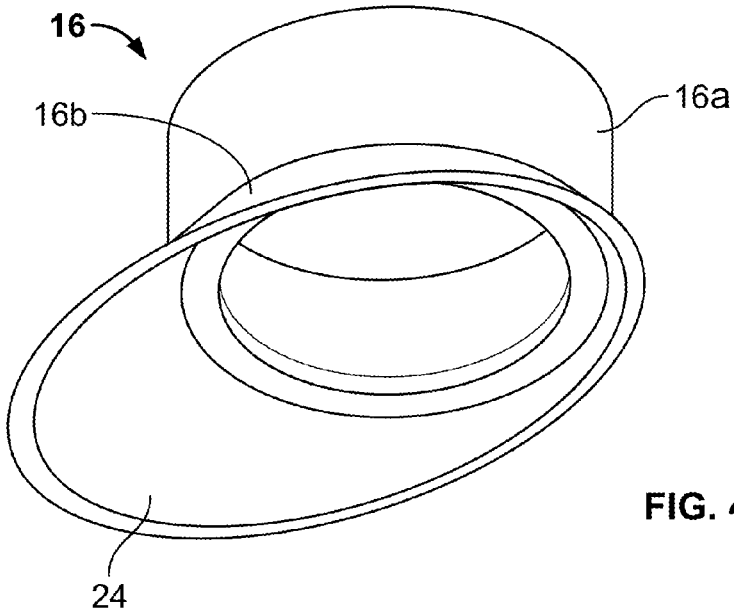
FIG. 4 is a bottom perspective view of an end piece of the dip tube assembly.

As shown in FIGS. 2A and 2B, the dip tube assembly 10 mainly includes a fitting 12, a tube 14 and an end piece 16 although the assembly 10 may include other additional components, such as for linking these components or connected at the ends of the assembly. FIGS. 3A and 3B show an alternative embodiment of the dip tube assembly 10.

The fitting 12 is a component that secures the dip tube assembly 10 to the container 100 such that the dip tube assembly 10 can maintain a desired orientation with respect to the container 100. The bottom portion of the fitting 12 inserted into the container 100 may be substantially cylindrical although the entire fitting 12 may be cylindrical (FIGS. 2A-2B), elbow-shaped (FIGS. 3A-3B) or otherwise. The fitting 12 may include a flange or flange members 18 that are caught or engaged by the container 100 such that the degree of insertion of the fitting 12 into the container 100 is limited. The top portion of the fitting may be operatively connected to the suction means 101. The orientation of the fitting 12 about the container 100 may be altered or rotated 360 degrees to accommodate neighboring plumbing to which the assembly 10 is connected.

In this embodiment, the tube 14 is a substantially straight structure with a first or top end 14*a* and a second or bottom end 14*b* although other configurations of the tube 14, whether bent, curved, spiraling, or otherwise, are also contemplated. The first end 14*a* of the tube 14 may be connected to the bottom portion of fitting 12 while the second end 14*b* of the tube 14 may be connected to the end piece 16. The dimensions of the tube 14 may depend on the dimensions of the container 100. For example, the length of the tube 14 may depend on the depth of the container 100. Moreover, the cross-sectional area of the tube 14 may be affected by factors such as the desired rate of flow out of the container, the power of the suction means, or the like.

Figure 5A:
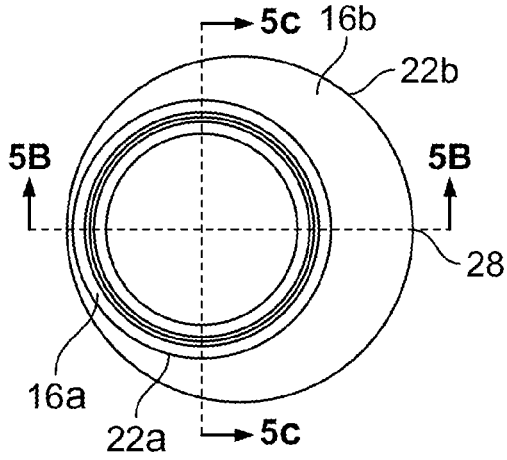
FIG. 5A is a top view of the end piece of the dip tube assembly.
Figure 5B:
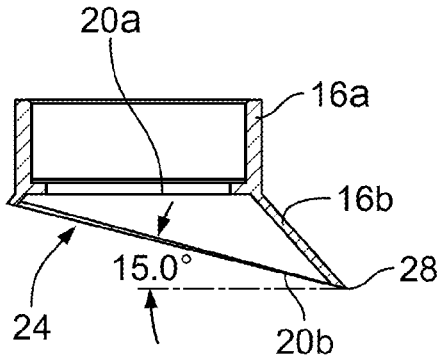
FIG. 5B is a cross-sectional view of the end piece through section 5B-5B.
Figure 5C:
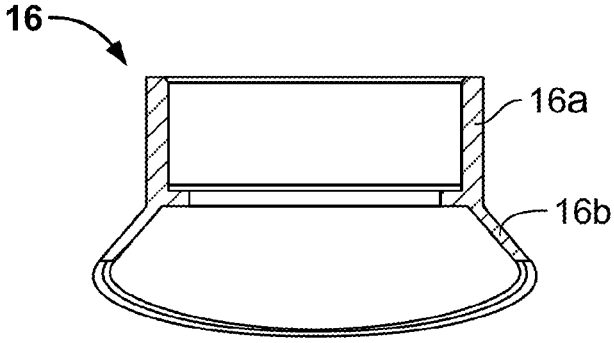
FIG. 5C is a cross-section view of the end piece through section 5C-5C.

The end piece 16 is a component of the assembly 10 that may either be close to or in contact with the matter or contents in the container 100. The end piece 16 may be monolithic being formed by way of molding or other means known in the art for manufacturing an integrally formed component. Alternatively, the end piece 16 may be assembled from a plurality of parts. The end piece 16 is hollow allowing passage of the matter from the container 100 through the end piece 16 to the tube 14. As shown in FIGS. 4 and 5A-5C, the end piece 16 primarily includes an upper part 16*a* and a lower part 16*b*. In this embodiment, the upper part 16*a* is substantially cylindrical corresponding to the shape of the tube 14 while the lower part 16*b* is substantially conical. The terms "cylindrical" or "tube" are not meant to convey that the bases have to be circular. Thus, the bases of a "cylinder" or a "tube" may be polygonal or some other suitable shape. More specifically, the shape of the lower part 16*b* is similar to a truncated portion of a cone but with an upper base 20*a* and a lower base 20*b* that are angled to each other. The upper base 20*a* and the lower base 20*b* may form an acute angle, for example, an angle of about 15° (FIG. 5B). This angle may be different in other example embodiments and may vary by a few degrees, a few tenth of a degree and so on. For example, the end piece 16 may be designed to have an angle within a range of 10°-20° and perform as desired. However, this aforementioned range is not intended to convey the only possible range of angle in which desired performance will be obtained and should not be construed as a limitation. The range in which desired performance is obtained may be smaller or greater.

The upper base 20*a* and the lower base 20*b* are connected or joined by a wall which encloses a hollow space through which matter passes. Although the wall is shown to be curved in this embodiment, the wall may, for example, be made up of a plurality of flat surface or have some other sort of irregular shape. The truncated portion of the cone is shaped such that the lower base 20*b* is larger in area than the upper base 20*a* such that the lower part 16*b* gradually tapers from the lower base 20*b* toward the upper base 20*a*. The upper base 20*a* has a first perimeter 22*a* and the lower base 20*b* has a second perimeter 22*b*, and the orientations of the upper base 20*a* and the lower base 20*b* may be such that the perimeters 22*a*, 22*b* of the upper and lower bases 20*a*, 20*b* abut. The term "abut" is meant to convey that the perimeters of the bases 20*a*, 20*b* are sufficiently close as to intersect or lie closely next to one another. For circular bases, the perimeters of the bases 20*a*, 20*b* may intersect at a point (FIG. 5A) or lie closely next to one another and, for polygonal bases, the perimeters of the bases may intersect at a point or at a segment or lie closely next to one another. In a mounted state of the assembly 10, the end piece 16 may be oriented such that the upper base 20*a* is substantially parallel to the ground or the floor 104 of the container 100 while the lower base 20*b* is angled with respect to the ground (FIG. 5B).

In the embodiment shown in FIGS. 4 and 5A-5C, the upper base 20*a* is circular while the lower base 20*b* has a substantially circular, oval shape and the lower base 20*b* provides an elliptical opening 24 through which the contents of the container can be sucked in. The larger area of the lower base 20*b* relative to the tube 14 and/or the geometry of the elliptical opening 24 slow down movement of the contents through the end piece 16 and contribute to preventing clogging during passage of the contents of the container 100 through the opening 24.

It is contemplated that, although the illustrated embodiment shows a truncated portion of a cone, the present invention encompasses other designs with variations in shape. For example, the truncated portion may be a portion of a pyramid instead of a cone. For example, the cone or the pyramid may be oblique. For example, the lower part 16*b* may have some sort of an irregular or deformed shape that cannot be categorized under some of the better known geometric classifications. Of course, the variations may exist in other parts of the end piece 16.

Figure 6A:
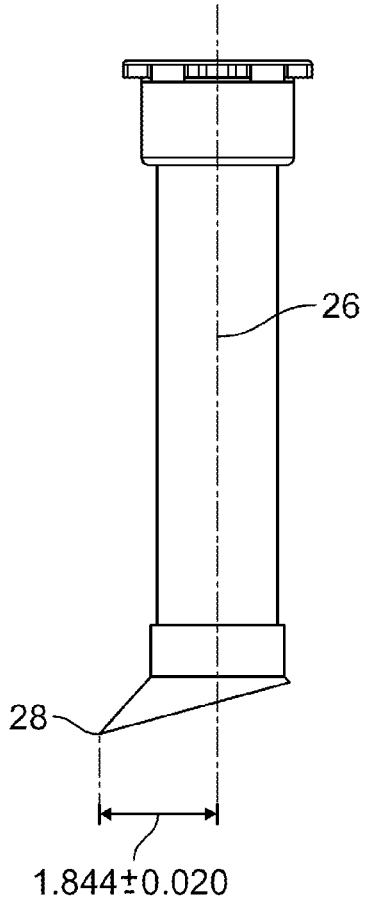
FIG. 6A is a side view of the dip tube assembly indicating dimensions.
Figure 6B:
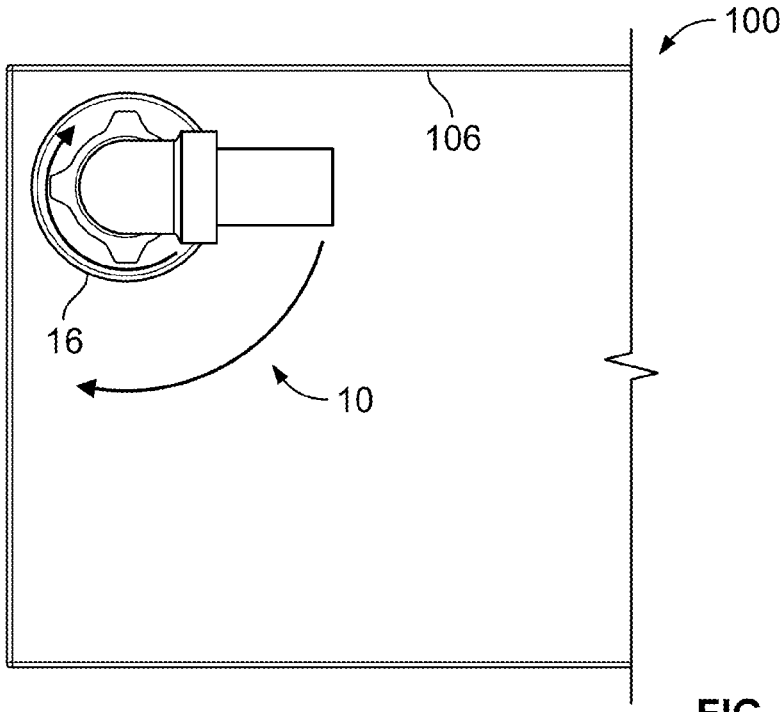
FIG. 6B is a top view of the container indicating a range of rotation of the dip tube assembly when mounted inside.

The upper part 16*a* of the end piece 16 may have a central axis 26 about which the upper part 16*a* may be symmetrical (FIG. 5B). The lower part 16*b* of the end piece 16 may be shaped such that a radially outermost end 28 on the lower base 20*b* is farthest from the central axis (FIG. 6A). In other words, the distance between the central axis 26 and the outermost end 28 is the maximum radius of the end piece 16 as measured from the central axis 26. In the present embodiment, this distance is about 1.8 inches, for example, 1.844 inches with a tolerance of 0.020. It may be possible in different embodiments to vary the tolerance or the distance. This distance affects where the fitting 12 is mounted with respect to the container 100 because the end piece 16 may need to be rotated for more effective suction of the contents, and the dip tube assembly 10 must be sufficiently distanced from a hull 106 of the container 100 to allow 360-degree rotation (FIG. 6B). The assembly is mounted about the hull 106 such that one or more walls of the hull 106 near or adjacent the assembly do not obstruct 360-degree rotation of the assembly. A dip tube assembly 10 with an outermost end 28 that is located farther from the central axis 26 will need to be mounted farther from the hull 106 and will in turn be closer to the middle of a top area of the container 100. Thus the assembly 10 is avoided from occupying space that could otherwise be available for the mounting of other container components. The present invention provides an end piece 16 that performs the desired functions while leaving sufficient space for the other components that need to be mounted to the container.

A desired characteristic of the components of the dip tube assembly 10 is resistance to corrosion since the container 100 and the dip tube assembly 10 may be exposed to various types of liquids. Thus the assembly 10 may be made of material such as polymers, stainless steel or the like.

Connection between the components of the assembly 10 or the components of the assembly 10 with the container 100 may be by insertion, snap-in, gluing, screws, nuts and bolts, welding, or other means known in the art. The components may simply be dimensioned with proper tolerances so as to establish a sufficiently tight fit with the connected component.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A container including:

a hull defining an interior space for storage;

a dip tube assembly for drawing in matter through suction from the container and configured to establish fluid communication with the interior space, the dip tube assembly including:

a fitting configured to secure the assembly to the hull;

a tube including a top end and a bottom end, the top end of the tube configured to be connected to the fitting, the tube comprising a longitudinal axis extending through the tube between the top end and the bottom end, and the tube being rotatable relative to the hull about said longitudinal axis; and an end piece including:

an upper part configured to be connected with the bottom end of the tube, and comprising a central axis arranged substantially concentric with the longitudinal axis of the tube; and a lower part including an upper base, a lower base and an enclosing wall by which the lower base is joined to the upper base, the enclosing wall defining a hollow space between the upper base and the lower base, the lower base being larger in area than the upper base such that the hollow space is tapered toward the upper base, the lower base providing an opening for matter to enter, the upper base and the lower base being at a non-zero angle relative to one another, wherein the upper base comprises a first perimeter that abuts a second perimeter of the lower base, the lower base being shaped such that a radially outermost end of the second perimeter is farthest from said central axis of the upper part to define a maximum radius of the end piece; and a vacuum source configured to draw matter into the end piece, wherein the dip tube assembly is positioned in close proximity to a wall of the hull and a maximum radius of the dip tube assembly within the interior space is constrained by the maximum radius of the end piece, such that the dip tube is rotatable 360 degrees relative to the hull without contacting said wall of the hull.

2. The container of claim 1, wherein the lower part is shaped as a truncated portion of a cone.

3. The container of claim 1, wherein the opening has an oval shape.

4. The container of claim 1, wherein the fitting is elbow-shaped.

5. A container including:

a hull defining an interior space for storage; and a dip tube assembly for drawing in matter through suction from the container, the dip tube assembly being in fluid communication with the container, the dip tube assembly including:

a fitting configured to secure the assembly to the container, the fitting configured to rotate 360-degree about the container;

a tube including a top end and a bottom end, the top end of the tube connected to the fitting; and an end piece including:

an upper part connected with the bottom end of the tube, and comprising a central axis; and a lower part including an upper base, a lower base and an enclosing wall by which the lower base is joined to the upper base, the enclosing wall defining a hollow space between the upper base and the lower base, the lower base being larger in area than the upper base such that the hollow space is tapered toward the upper base, the lower base providing an opening for matter to enter, the upper base and the lower base being at a non-zero angle relative to one another, wherein the upper base comprises a first perimeter and the lower base comprises a second perimeter, the lower base being shaped such that a radially outermost end of the second perimeter is farthest from said central axis of the upper part to define a maximum radius of the end piece, wherein the hull includes a wall adjacent to the assembly and the assembly is mounted to the container in close proximity to the wall, and spaced a distance from the wall greater than the maximum radius of the end piece such that the radially outermost end of the lower part can be rotated 360 degrees without contacting the wall.

6. The container of claim 5, wherein the end piece is oriented such that the upper base is substantially parallel to a ground.

7. The container of claim 5, wherein the fitting is mounted from above the container.

8. The container of claim 5, wherein the assembly is dimensioned such that the opening is near a floor of the container.

* * * * *